US006164484A

United States Patent [19]

Fiore et al.

[11] Patent Number: 6,164,484

[45] Date of Patent: Dec. 26, 2000

[54] INSULATED SNAP FIT CONTAINER LID

[75] Inventors: Joseph Frank Fiore, Lebanon, Pa.; Kathleen G. Peeples, Houston, Tex.

[73] Assignee: Igloo Corporation, Houston, Tex.

[21] Appl. No.: 09/211,625

[22] Filed: Dec. 15, 1998

[51] Int. Cl.[7] ..... B65D 81/38

[52] U.S. Cl. ..... 220/521; 220/780; 220/782; 220/366.1; 220/367.1; 206/545

[58] Field of Search ..... 220/592.01, 592.09, 220/592.1, 592.11, 592.2, 592.21, 592.25, 592.26, 592.27, 4.21, 4.24, 305, 780, 781, 782, 785, 792, 796, 626, 627, 366.1, 521, 522, 915.1, 915.2, DIG. 9, 367.1; 206/545, 550, 543, 544; 426/109; 62/457.1

[56] References Cited

U.S. PATENT DOCUMENTS

| | | | |
|---|---|---|---|
| D. 243,231 | 2/1977 | Smith . | |
| D. 374,822 | 10/1996 | Philips . | |
| 2,301,510 | 11/1942 | Bolen | 220/522 |
| 2,711,840 | 6/1955 | Gits et al. . | |
| 2,766,796 | 10/1956 | Tupper | 220/521 |
| 3,101,864 | 8/1963 | Glickman . | |
| 3,320,993 | 5/1967 | Motsenbocker . | |
| 3,339,786 | 9/1967 | Biglin . | |
| 3,484,015 | 12/1969 | Rowan | 206/545 |
| 3,595,425 | 7/1971 | Eicholtz | 220/780 |
| 3,613,933 | 10/1971 | Pilz | 206/545 |
| 3,732,909 | 5/1973 | Rooke et al. | 220/792 |
| 3,805,994 | 4/1974 | Cherry et al. . | |
| 3,809,284 | 5/1974 | Churan . | |
| 4,166,548 | 9/1979 | Crisci . | |
| 4,209,107 | 6/1980 | Crisci . | |
| 4,213,537 | 7/1980 | Caccavale | 220/780 |
| 4,223,800 | 9/1980 | Fishman | 220/522 |
| 4,256,240 | 3/1981 | Woinarski . | |
| 4,390,113 | 6/1983 | Bird | 220/785 |
| 4,561,562 | 12/1985 | Trombly . | |
| 4,574,974 | 3/1986 | von Holdt . | |
| 4,782,976 | 11/1988 | Kenyon, II . | |
| 4,886,184 | 12/1989 | Chamourian | 220/781 |
| 5,016,756 | 5/1991 | Wischhusen et al. | 206/545 |
| 5,052,369 | 10/1991 | Johnson | 206/545 |
| 5,228,314 | 7/1993 | Kawai | 62/457.1 X |
| 5,373,955 | 12/1994 | Marino . | |
| 5,377,860 | 1/1995 | Littlejohn et al. | 220/4.21 |
| 5,377,861 | 1/1995 | Landis | 220/781 |
| 5,383,565 | 1/1995 | Luch . | |
| 5,520,103 | 5/1996 | Zielinski et al. | 220/592.01 |
| 5,701,757 | 12/1997 | Heverly | 220/915.1 |
| 5,704,485 | 1/1998 | Cautereels et al. | 62/457.1 X |
| 5,885,636 | 3/1999 | Carville | 206/545 X |
| 5,894,953 | 4/1999 | Ramirez | 220/366.1 |

FOREIGN PATENT DOCUMENTS

| | | | |
|---|---|---|---|
| 8-72944 | 3/1996 | Japan | 220/366.1 |
| 8-156956 | 6/1996 | Japan . | |
| 8-230915 | 9/1996 | Japan . | |
| 97/07966 | 3/1997 | WIPO . | |

*Primary Examiner*—Nathan J. Newhouse
*Attorney, Agent, or Firm*—Duane, Morris & Heckscher LLP

[57] ABSTRACT

A snap fit lid for a container is described. The lid can be made to incorporate thermal insulation and engages the container internally and at its edge to form a double seal. An annular gap is formed between the double seals. A groove runs transversely to the annular gap across the internal and external seals to allow pressure equalization in the container with its surrounding environment. The closure straddles the container at its top and snaps to the container top to create a pair of offset opposed seals for a snug fit to the container. The closure is particularly amenable to use in tray sized containers used extensively in foodservice applications.

4 Claims, 4 Drawing Sheets

INSULATED SNAP FIT CONTAINER LID

FIELD OF THE INVENTION

The field of this invention relates to closures for a variety of containers, for example, and more specifically to food storage containers, principally useful in volume feeding applications.

BACKGROUND OF THE INVENTION

Many designs have been developed for snap closures for containers. Typical of such designs are U.S. Pat. Nos. 3,805,994; 4,561,562; 4,209,107; 4,574,974; 4,782,976; 5,373,955; 5,383,565; 4,256,240; 3,320,993; 3,101,864; 4,166,548; 2,711,840; 3,339,786; 3,809,284; design 243, 231; and design 374,822.

Lacking in the prior designs is a simple structure for a snap fit lid which firmly engages the container internally, as well as at its edge, to form a double seal while additionally providing the benefits of thermal insulation to keep contents warm or cold, and incorporating into the design a venting feature which operates bidirectionally to relieve internal overpressure or vacuum due to temperature effects from the contents in the container. Apart from the simple construction incorporating a double seal, the physical execution of the double seal enhances the grip of the closure on the container by preferentially applying as much of the available forces accumulated from assembling the snap fit lid to the container into contact forces to maintain the internal and external seals. The aspects of the design of the present invention referred to above will be more clearly understood from a review of the preferred embodiment described below.

SUMMARY OF THE INVENTION

A snap fit lid for a container is described. The lid can be made to incorporate thermal insulation, and engages the container internally and at its edge to form a double seal. An annular gap is formed between the double seals. A groove runs transversely to the annular gap across the internal and external seals to allow pressure equalization in the container with its surrounding environment. The closure straddles the container at its top and snaps to the container top to create a pair of offset opposed seals for a snug fit to the container. The closure is particularly amenable to use in tray-sized containers used extensively in foodservice applications.

DETAILED DESCRIPTION OF THE PREFERRED EMBODIMENT

Figure 1:
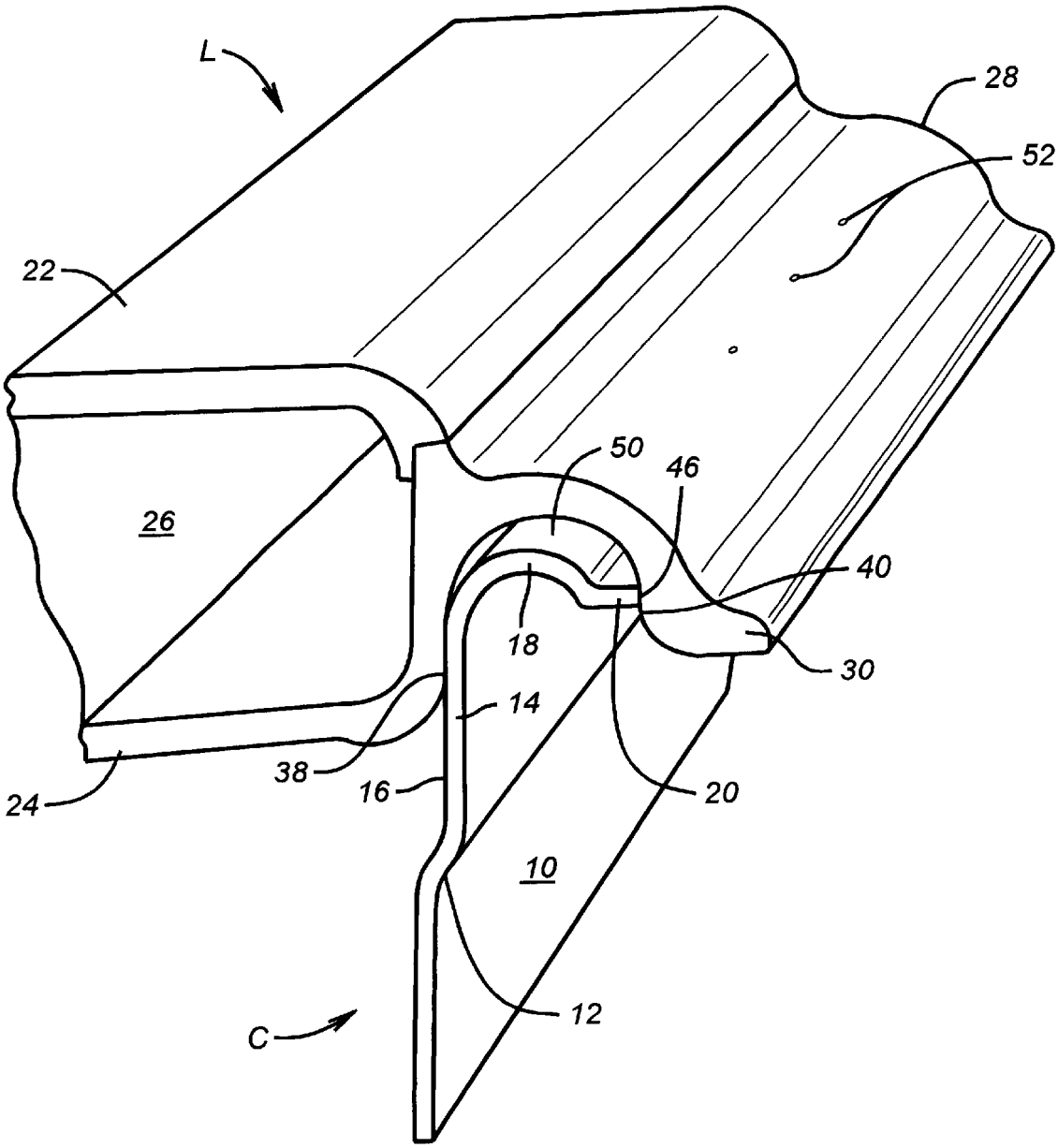
FIG. 1 is a section view of a portion of the container and closure, illustrating the double seal for the container formed by the closure where the closure has a space on its top to accommodate an insulating material or gas or fluid.

Referring to FIG. 1, the wall 10 of the container C is shown in a sectional elevational view. Above bend 12 is a vertical or near vertical component 14 having an internal surface 16. From there, a curved component 18 extends from the vertical component 14, followed by an end component

20 which is oriented substantially perpendicular to the vertical component 14. Together, components 18 and 20 define a lip. Thus, the lip comprises a curved section 18 and a straight section 20.

The lid L has a top component 22 and a bottom component 24 spaced apart from top component 22. Known insulating materials or fluids or gases can be used in the sealed space 26 formed between the top and bottom components 22 and 24. Vacuum panels can be used, or a eutectic material, or gels or aerogels. Extending from the top and bottom components 22 and 24 is an arcuate peripheral component 28, which spans over the curved component 18 of the container C as well as the end component 20 of the container C. The lid L has an end component 30 which extends beyond end component 20 of the container C.

Figure 3:
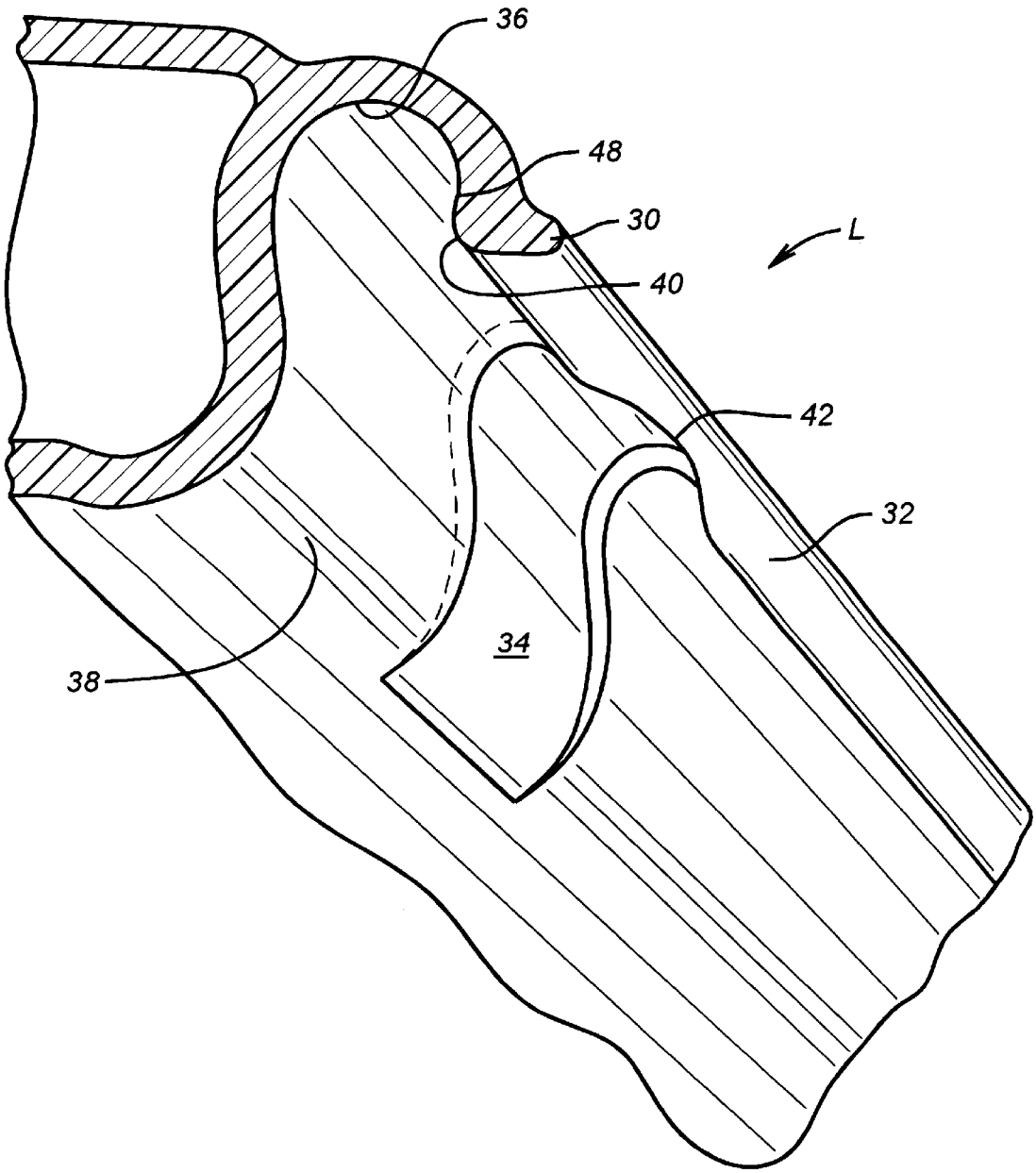
FIGS. 3 and 4 are perspective views of the embodiment shown in FIG. 1, illustrating the full extent of the vent groove to allow pressure equalization as between the internals of the container and its surrounding environment.
Figure 4:
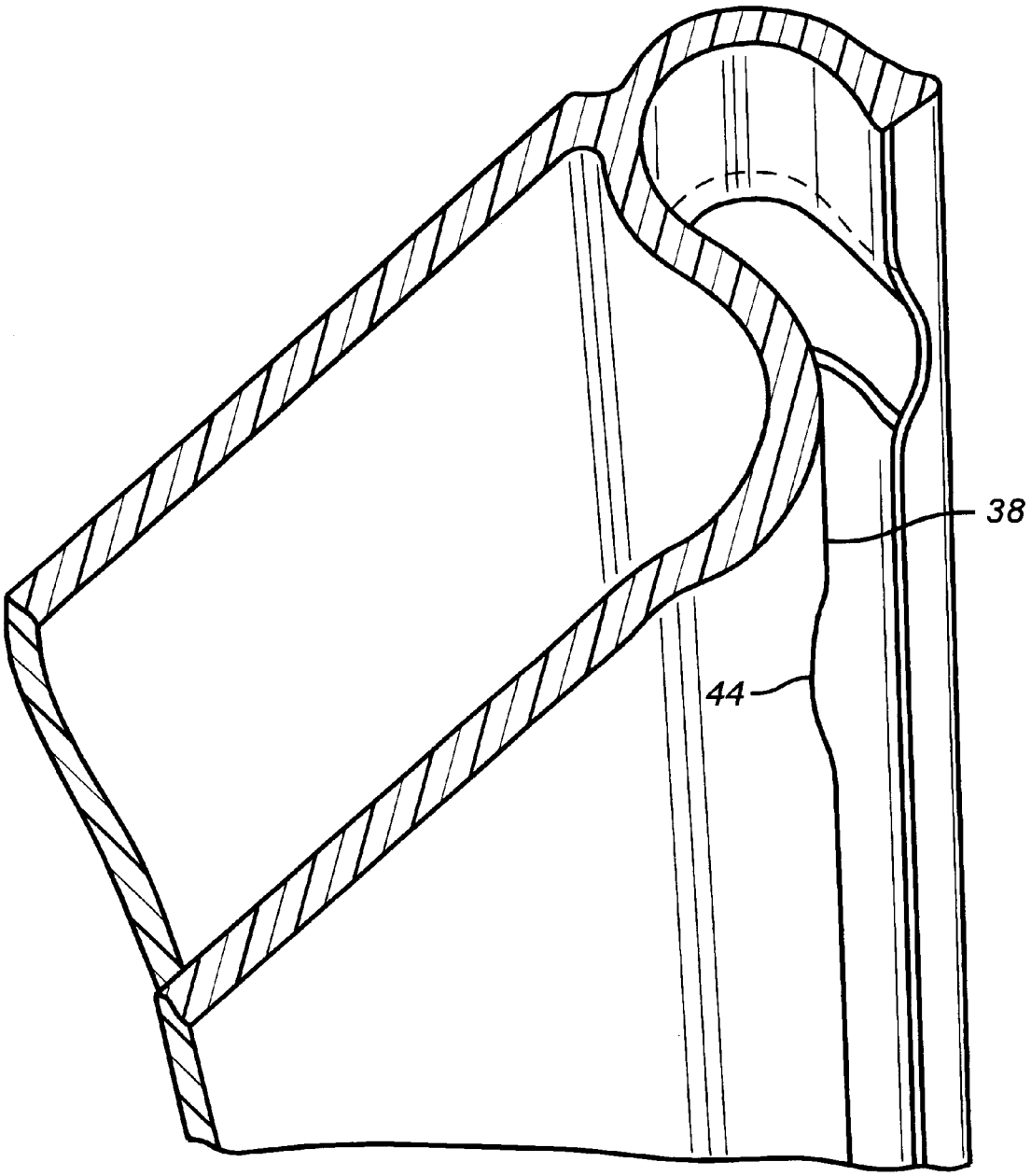

Referring to FIG. 3, end component 30 of lid L has a bottom surface 32 which is penetrated by a groove 34. Groove 34 extends into interior surface 36. Internal surface 36 defines two sealing areas, internal sealing area 38 and external sealing area 40. Thus, groove 34 has one end 42 and bottom surface 32 as shown in FIG. 3, and the opposite end 44 through and beyond internal sealing area 38.

Figure 2:
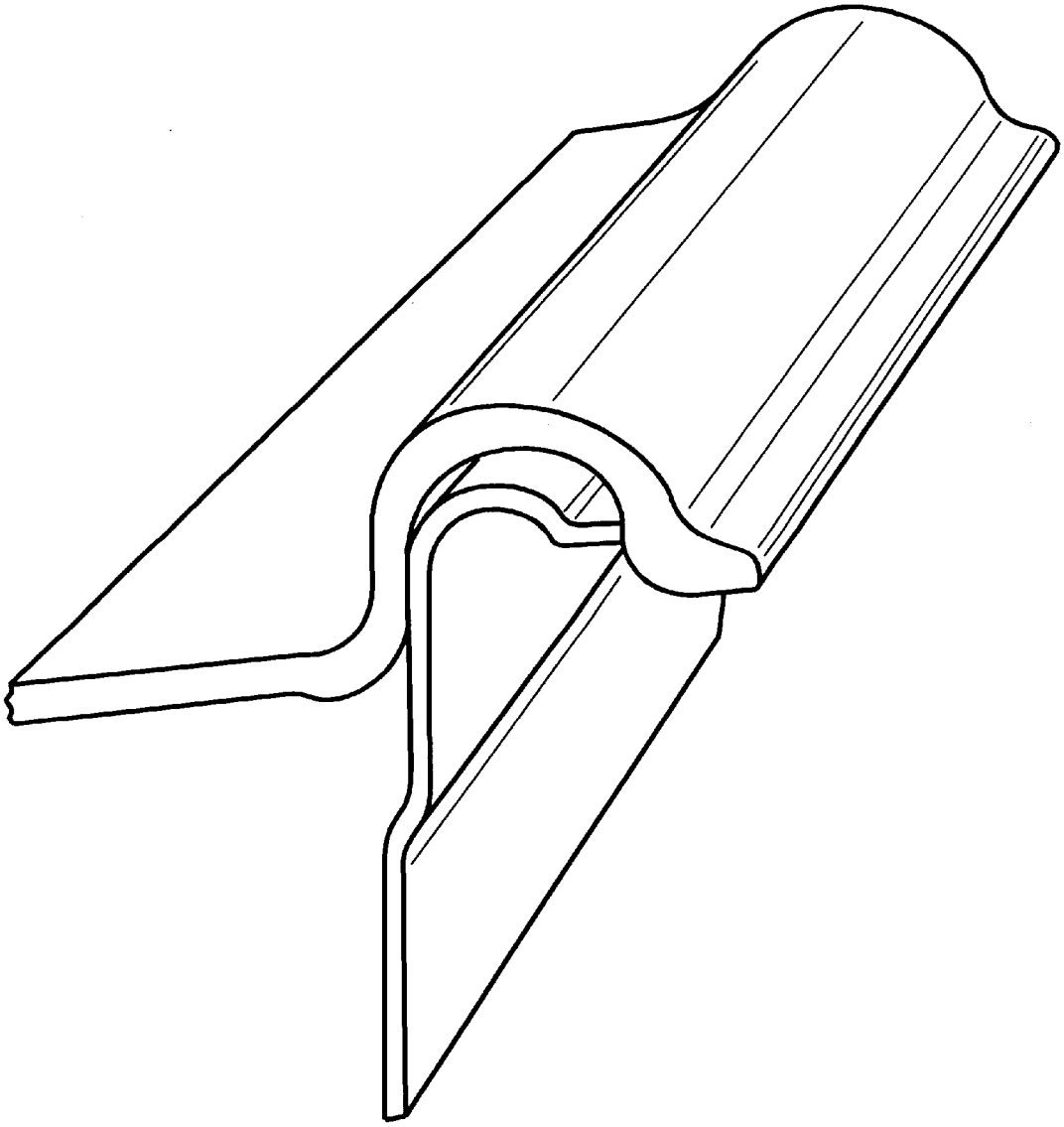
FIG. 2 is an alternative embodiment to FIG. 1 which eliminates the insulation feature in the top of the closure.

FIG. 2 is functionally identical to FIG. 1 except that the lid L is not configured to incorporate the sealed space 26 and, therefore, has no insulating material or liquid or gas in the main part of the lid L for keeping the contents in the container C warm or cold, as the case may be.

The principal components of the closure now having been described, those skilled in the art will now be able to discern how it functions. The physical gap between internal sealing surface 38 and external sealing surface 40 is less than the distance from internal wall 16 of the container C and its end 46. Thus, when firmly pressing down the lid L on the container C, internal sealing area 38 is dragged down internal wall 16 because end 46 is pushing outwardly on external sealing area 40. The internal seal is formed by contact between wall 16 and internal sealing area 38, while at the same time the interference fit has the end component 20 of the container C pushing outwardly on external sealing area 40. As shown in FIG. 3, external sealing area 40 has a transition point 48 which helps to engage and locate the end 46 of the lid L. Because the top of the container C is configured as shown in FIG. 1, the placement of the lid L on the container C takes advantage of opposed nearly horizontal forces, which push together the internal sealing area 38 against the wall 16 internally to the container C, while at the same time an opposite force results in an enhancement of the sealing contact of end 46 of the container C onto the transition 48 which forms a part of the external seal area 40.

The fact that the groove 34 extends beyond the internal seal area 38 allows gases but not necessarily liquids to come through the groove 34 all the way past bottom surface 32 on end component 30 in both directions. Thus, if hot food in the container cools reducing the pressure, flow through groove 34 into the container C occurs, while similarly if the food in the container C is warmed to increase the internal pressure with lid L, applied excess pressure buildup exits through the groove 34 while retaining liquids within the container C. Alternative designs to groove 34 can also be used which involve a shortening of groove 34 so that it communicates only through the internal sealing area 38. The annular gap 50 can be vented to the surrounding atmosphere through small holes such as 52, which will allow gas to pass under a minimal differential pressure while retaining liquid. The holes can be provided in a manner that keeps them liquid tight but allows them to pass gas with fairly minimal differential pressures to avoid blowing the entire lid L off the container C or collapsing it.

Those skilled in the art will appreciate that it is important to maintain the quality and purity of the contents of the container C by having a lid system which maintains proper food temperature as well as provides a good reliable seal at the periphery of the container C. Various standards have been promulgated for food-handling containers, particularly those used in foodservice applications. The double-wall design incorporating the insulation material or gas or liquid in between in sealed space 26 allows for maintenance of the temperature of the contents for a longer period of time. The incidence of spillage is reduced, if not eliminated, by this design which employs a simple snap fit structure where the lid L makes two seals with the container C where the seals are opposed and somewhat offset from each other, and the curvature of the container C acts to put sealing forces normal to sealing surfaces 38 and 40 for the formation of the double seal. The venting feature accomplished by groove 34 or alternatively, in conjunction with vent opening 62, allows for the easy passage of gaseous materials in either direction while having an ability to retain liquids in the container should it become inadvertently tipped.

The lid L can be made by blow molding techniques or gas inject technology to facilitate the creation of the sealed space 26 for insulation purposes. The material for the lid can be an elastomeric to facilitate the compression necessary to employ the interference fit of the lid L to the container C. The lid L is aggressively captured on the container C by use of the internal and external seals at 38 and 40. Using an elastomeric material helps to compensate for dimensional inconsistencies in the container C.

The foregoing disclosure and description of the invention are illustrative and explanatory thereof, and various changes in the size, shape, and materials, as well as in the details of the illustrated construction, may be made without departing from the spirit of the invention.

What is claimed is:

1. A container and lid combination, comprising:

a. a container having a wall having an outer end;

b. a lid adapted to snap fit over said wall for sealing retention thereto, said lid comprising opposed walls defining a compartment there between;

c. said lid forming a first seal in said container and a second seal with said outer end;

d. said lid defining a break thereon to allow pressure equalization through said first seal between said lid and said wall of said container and e. said lid and said container defining an annular space between said first and second seals, said break providing access to said annular space from said container, and at least one opening into the annular space for pressure equalization of the container through said annular space.

2. The combination of claim 1, wherein:

said opening is sized to pass gases and retain liquids during pressure equalization.

3. The container and lid combination of claim 1, wherein said opening is a hole sized to allow gas to pass while retaining liquid.

4. The container and lid combination of claim 1, further comprising at least two openings into the annular space for pressure equalization of the container through said annular space.

* * * * *